US005847739A

United States Patent [19]

Kanaya et al.

[11] Patent Number: 5,847,739

[45] Date of Patent: Dec. 8, 1998

[54] CLOTH FEEDING DRUM FOR INK-JET PRINTING

[75] Inventors: Yoshihiro Kanaya; Ryouichi Shimada; Kouichi Sugioka, all of Fukui-ken, Japan

[73] Assignee: Seiren Co., Ltd., Fukui-ken, Japan

[21] Appl. No.: 574,236

[22] Filed: Dec. 18, 1995

[30] Foreign Application Priority Data

Dec. 23, 1994 [JP] Japan ..... 6-336254

[51] Int. Cl.[6] ..... B41J 3/407

[52] U.S. Cl. ..... 347/106; 26/96; 226/81

[58] Field of Search ..... 26/90, 96, 99; 226/19, 53, 81; 346/136, 138; 347/105, 106

[56] References Cited

U.S. PATENT DOCUMENTS

| | | | |
|---|---|---|---|
| 1,085,538 | 1/1914 | Burgess et al. | 26/96 |
| 1,345,634 | 7/1920 | Raymond | 26/96 |
| 2,317,384 | 4/1943 | Johnson | 164/84.5 |
| 2,402,074 | 6/1946 | Nield | 226/81 |
| 3,285,484 | 11/1966 | Johnson | 346/136 |
| 3,721,377 | 3/1973 | Atkinson | 226/74 |
| 4,136,809 | 1/1979 | Engelmann et al. | 226/78 |
| 4,162,032 | 7/1979 | Lockwood | 226/81 |
| 4,734,868 | 3/1988 | Delacy | 346/136 |
| 5,017,943 | 5/1991 | Ogita et al. | 346/136 |
| 5,022,336 | 6/1991 | Iwase | 226/53 |
| 5,320,267 | 6/1994 | Oono et al. | 226/53 |

FOREIGN PATENT DOCUMENTS

| | | | |
|---|---|---|---|
| 574240A1 | 12/1993 | European Pat. Off. | B65H 20/20 |
| 58-109673 | 6/1983 | Japan | D06B 11/00 |
| 2-149790 | 12/1990 | Japan | D06B 23/04 |
| 405861 | 7/1963 | Switzerland . | |

*Primary Examiner*—Jeffrey Sterrett

*Attorney, Agent, or Firm*—Finnegan, Henderson, Farabow, Garrett & Dunner

[57] ABSTRACT

A method of carrying out ink Jet printing includes the steps of: introducing a cloth on which ink Jet printing is to be carried out onto a cloth feeding drum having a plurality of support pins for holding the cloth on the cloth feeding drum; and moving the support pins in the radial direction of the cloth feeding drum at least when the cloth is introduced onto the cloth feeding drum. Further, the method may also include the step of moving the support pins in the axial direction of the cloth feeding drum to apply a tension to the cloth held by the support pins on the cloth feeding drum after the cloth is introduced onto the cloth feeding drum. A cloth feeding drum for use in ink jet printing includes a cloth feeding drum having a plurality of support pins for holding a cloth on which ink jet printing is to be carried out on the cloth feeding drum; and a mechanism provided within the cloth feeding drum for moving the support pins in the radial direction of the cloth feeding drum at least when the cloth is introduced onto the cloth feeding drum. The cloth feeding drum may further include a mechanism for moving the support pins in the axial direction of the cloth feeding drum so as to apply a tension to the cloth held by the support pins. These mechanisms are actuated at least when the cloth is introduced onto the cloth feeding drum and after the cloth is introduced onto the cloth feeding drum, respectively.

19 Claims, 13 Drawing Sheets

CLOTH FEEDING DRUM FOR INK-JET PRINTING

BACKGROUND OF THE INVENTION

1. Field of the Invention

The present invention relates to an ink jet printing method and a cloth feeding drum for holding a cloth on which ink jet printing is to be carried out in accordance with such ink jet printing method. Further, the present invention also relates to an ink jet printing apparatus including the above-mentioned cloth feeding drum.

2. Description of the Prior Art

In recent years, ink jet coloring has been receiving attention for its use since it can produce fine and delicate patterns. In such ink jet coloring method, an ink jet nozzle sprays ink droplets toward the surface of a cloth to form a pattern thereon, and then such printed coloring substance is fixed and undergoes a coloring treatment.

In this connection, one of the most important technical steps in the ink jet coloring process is the ink jet printing step, namely the step of spraying ink droplets onto a cloth surface.

Concretely stated, the ink jet printing is carried out by spraying ink droplets from a printing nozzle N onto the surface of a cloth which is held by an intermittently rotating cloth feeding drum, as shown in FIG. 13. The spraying operation is controlled by instructions from a control section P. In such arrangement, the cloth is normally held with a prescribed tension by support pins mounted around drum wheels which are provided at the opposite end portions of the cloth feeding drum, respectively. Such a structure is also disclosed in Laid-Open Patent Application No. SHO 58-109673 and Laid-Open Utility Model Application No. HEI 2-149790 and the like.

However, with such prior art cloth feeding drums, it is not always possible to achieve satisfactory results due to the problem resulted from the tension applied to the cloth in the widthwise direction thereof. Further, the operations of piercing the cloth with the support pins and then removing such support pins from the cloth are also not possible to achieve satisfactory results.

The reasons which cause such unsatisfactory results are described below.

First, with regard to the tension applied to the cloth along the widthwise direction thereof, the following reasons can be mentioned.

In order to accurately form fine and delicate patterns with ink jet printing, the distance between the ink jet nozzle and the cloth surface must be kept constant while the nozzle head is moving along the width of the cloth, and the cloth printing surface must be substantially flat.

However, the cloth to be introduced into the printing process has distortion and wrinkles which have been formed in the previous process. Therefore, at the time of printing, it is necessary to apply appropriate tension to the cloth which is held by the support pins on the cloth feeding drum for stretching the wrinkles.

Further, after printing, the ink that has been applied to the cloth causes the cloth to swell up due to its moisture, thereby also forming wrinkles. Therefore, it is also necessary to apply appropriate tension to the cloth even after printing in order to prevent such wrinkles or the like from being formed.

For these reasons, it is not possible to achieve sufficient results only by simply applying a fixed tension to the cloth.

In other words, in order to obtain sufficient results, it becomes necessary to change the degree of tension for each of the step of introducing the cloth, the step of performing the ink jet printing onto the cloth and the step after printing in which the cloth is likely to swell up.

In other words, it is necessary for the degree of tension applied to the cloth to be adjusted or changed in accordance with the degree of the rotation of the cloth feeding drum.

Moreover, it is also preferred that the manner and degree for applying tension to a cloth are selected in accordance with the type of cloth, taking into account such factors as the material, the thickness, the structure and the standard of such a cloth.

Next, with regard to the operations of piercing support pins into a cloth and removing the support pins from the cloth, the following reasons can be mentioned.

At the time of ink Jet printing, a cloth is introduced onto an introducing region X of the cloth feeding drum, and then the operation of piercing the cloth with the support pins is carried out at the introducing region X. However, with prior art cloth feeding drums, when the cloth is pierced by the support pins at the introducing region X, the support pins pierce the cloth surface in a slanting direction (See FIG. 1).

Then, as the cloth feeding drum rotates, the support pins gradually pass through the cloth. Thereafter, when the support pins are perpendicular to the cloth, the cloth becomes held by the base portions of the support pins.

For this reason, the operation of piercing the cloth with the support pins can not be carried out smoothly. Furthermore, during the piercing process from the moment when the support pins begin to pierce the cloth until the moment when the cloth reaches the base portions of the support pins at the time the support pins become perpendicular to the cloth, the holding strength for the cloth by the support pins is weak and this results in an extremely unstable condition.

On the other hand, when the cloth is to be separated from the cloth feeding drum at the separating region Z, an operation is carried out to pull the cloth off the support pins. In this case, as the cloth feeding drum rotates, the support pins are slowly pulled out from the cloth with rubbing against the cloth. Finally, the support pins are removed from the cloth at the moment when the support pins are at a maximum slant with respect to the cloth surface and then the tips thereof are pulled out from the cloth (See FIG. 2).

For this reason, the support pins can not be smoothly pulled out of the cloth. In other words, during the separation process from the state in which the cloth is pierced by the base portions of the support pins until the state in which the support pins are completely removed from the cloth, the cloth is not sufficiently held by the support pins, which gives an extremely unstable holding condition for the cloth.

Therefore, in the prior art cloth feeding drums, it is not possible to hold a cloth stably on the cloth feeding drums, since the tension applied in the widthwise direction of the cloth is insufficient and the operations of piercing and removing support pins into and from a cloth can not be carried out smoothly due to the reasons as described in the above.

When such unstable holding conditions exist, it is not possible to maintain a fixed uniform distance between the ink jet nozzle and the printing surface of the cloth while the ink jet nozzle is moving along the widthwise direction of the cloth. Further, such unstable holding condition also causes a deterioration in the structure of the cloth and gives rise to distortions or wrinkles or the like.

Furthermore, the cloth feeding speed also changes, and this will also produce distortions in the pattern printed on the cloth.

SUMMARY OF THE INVENTION

This invention is made in view of the problems of the prior art cloth feeding drums as described above.

Accordingly, it is an object of the present invention to provide an ink jet printing method which enables distortion-free patterns to be accurately printed onto a cloth.

It is another object of the present invention to provide a cloth feeding drum which enables distortion-free patterns to be accurately printed onto a cloth.

It is the other object of the present invention to provide a cloth feeding drum which enables piercing of a cloth with support pins and removal of such support pins from the cloth to be carried out smoothly.

It is a further object of the present invention to provide a cloth feeding drum which enables the degree of stretching tension applied to the widthwise direction of a cloth to be changed or adjusted.

In order to achieve these objects, the inventors of the present invention repeated experiments, and as a result, the inventors have found that the problems of the prior art could be eliminated by moving the support pins in the axial and/or radial directions of the cloth feeding drum, and this knowledge was then used by the inventors to accomplish the present invention.

Therefore, the present invention is directed to a method of carrying out ink jet printing, which comprises the steps of introducing a cloth on which ink jet printing is to be carried out onto a cloth feeding drum having a plurality of support pins for holding the cloth on the cloth feeding drum; and moving the support pins in the radial direction of the cloth feeding drum at least when the cloth is introduced onto the cloth feeding drum. In this case, the support pins are moved so as to protrude above the surface of the cloth feeding drum to pierce the cloth with the support pins. Further, the support pins are also moved so as to retract below the surface of the cloth feeding drum when the cloth is removed from the cloth feeding drum.

According to the method as described above, the cloth is pierced with the support pins which protrude above the surface of the cloth feeding drum from the inside thereof when the cloth is introduced onto the cloth feeding drum, such operation of piercing the cloth with the support pins can be carried out smoothly.

The method of carrying out ink jet printing according to the present invention may further comprise the step of moving the support pins in the axial direction of the cloth feeding drum to apply a tension to the cloth held on the cloth feeding drum after the cloth is introduced onto said cloth feeding drum.

According to this method, it is possible to apply an appropriate tension to the cloth for stretching wrinkles or the like that have been formed on the cloth during the previous step. As a result, ink Jet printing operation can be carried out onto such stretched cloth. Further, wrinkles or the like which have been produced when the ink jet printing is being carried out can also be stretched.

Another aspect of the present invention is directed to a method of carrying out ink jet printing, which comprises the steps of holding a cloth on which ink jet printing is to be carried out onto a cloth feeding drum having a plurality of support pins using the support pins; and carrying out ink jet printing while the support pins are being moved in the axial direction of the cloth feeding drum so as to apply a tension to the cloth.

Further, the other aspect of the present invention is also directed to a cloth feeding drum for use in ink jet printing. The cloth feeding drum includes a drum having a plurality of support pins for holding a cloth on which ink jet printing is to be carried out on the drum; and a mechanism provided within the drum for moving the support pins in the radial direction of the drum.

In this case, it is preferred that the moving mechanism is adapted to be actuated at least when the cloth is introduced onto the drum. Further, it is also preferred that the moving mechanism is adapted to move the support pins in such a manner that the support pins protrude above the surface of the drum to pierce the cloth with the support pins.

Furthermore, the other aspect of the present invention is directed to a cloth feeding drum for use in ink jet printing. The cloth feeding drum includes a drum having a plurality of support pins for holding a cloth on which ink jet printing is to be carried out; and a mechanism provided within the drum for moving the support pins in the axial direction of the drum so as to apply a tension to the cloth in the widthwise direction thereof.

In this case, it is preferred that the moving mechanism is adapted to be actuated after the cloth is introduced onto the drum. Further, it is also preferred that the cloth feeding drum further includes a mechanism for adjusting the moving amount of the support pins.

Other aspect of the present invention is also directed to another cloth feeding drum for use in Ink jet printing. This cloth feeding drum includes a drum having a plurality of support pins for holding a cloth on which ink jet printing is to be carried out on the drum; a first mechanism provided within the drum for moving the support pins in the radial direction of the drum; and a second mechanism provided within the drum for moving the support pins in the axial direction of the drum.

In this case, it is preferred that the first mechanism is actuated at least when the cloth is introduced onto the drum, and the second mechanism is actuated after cloth is introduced onto the drum. Further, it is also preferred that the cloth feeding drum further comprising a third mechanism for adjusting the moving amount of the support pins moved by the first and/or second mechanisms.

The present invention is also directed to an ink jet printing apparatus. This ink jet printing apparatus includes a rotatable cloth feeding drum having a plurality of support pins for holding a cloth on which ink jet printing is to be carried out on the cloth feeding drum; a nozzle for spraying ink onto the cloth held by the support pins to perform the ink jet printing, the nozzle being movable relative to the cloth feeding drum along the axial direction thereof; and a mechanism for applying appropriate tension to the cloth in the widthwise direction of the cloth while the ink jet printing is being carried out.

In this case, it is preferred that the tension applying mechanism is adapted to move the support pins provided in at least one of the opposite end portions in the axial direction of the cloth feeding drum. The tension applying mechanism is preferably formed from a first cam provided within the cloth feeding drum for moving the support pins in the axial direction of the cloth feeding drum. Further, it is also preferred that the ink jet printing apparatus further comprises a mechanism for adjusting the moving amount of the support pins moved by the tension applying mechanism in the axial direction of the cloth feeding drum.

Furthermore, this ink jet printing apparatus may further includes another mechanism for moving the support pins in the radial direction of the cloth feeding drum. Preferably, this mechanism for moving the support pins in the radial direction of the cloth feeding drum is adapted to protrude the support pins above the surface of the cloth feeding drum to pierce the cloth with the support pins at least when the cloth is introduced onto the cloth feeding drum and retract the pins into the cloth feeding drum to remove the pins from the cloth when the cloth is released from the cloth feeding drum. Further, it is also preferred that the mechanism for moving the support pins in the radial direction includes a second cam provided within the cloth feeding drum for moving the support pins in the radial direction of the cloth feeding drum. Moreover, it is also preferred that the ink jet printing apparatus further comprises a mechanism for adjusting the moving amount of the support pins moved by the mechanism in the radial direction of the cloth feeding drum.

Other objects, structures and functions of the present invention will become apparent when the following description of the preferred embodiments will be considered in conjunction with the appended drawings.

DETAILED DESCRIPTION OF THE PREFERRED EMBODIMENTS

With reference to the appended drawings, a detailed description of the preferred embodiments will now be given below.

Figure 1:
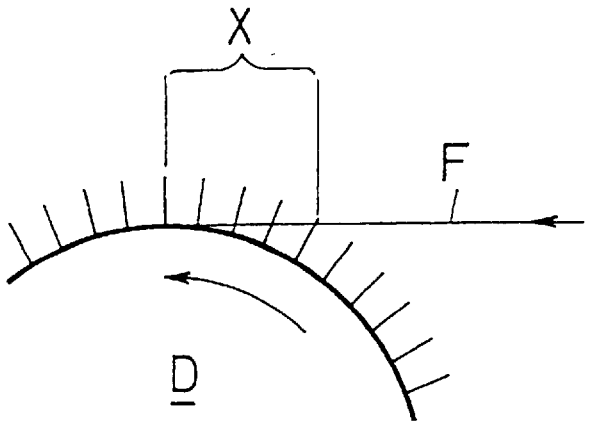
Fig. 1 Prior Art
FIG. 1 is an illustration which shows a relationship between a cloth and support pins at a cloth introducing region X of a cloth feeding drum.
Figure 2:
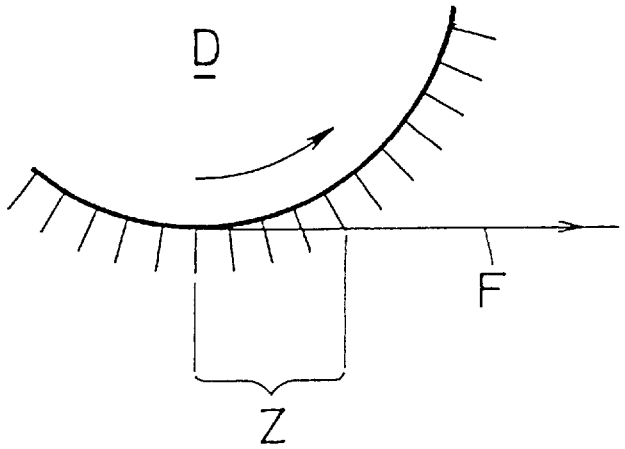
Fig. 2 Prior Art
FIG. 2 is an illustration which shows a relationship between the cloth and the support pins at a cloth separating region Z of the cloth feeding drum.
Figure 3:
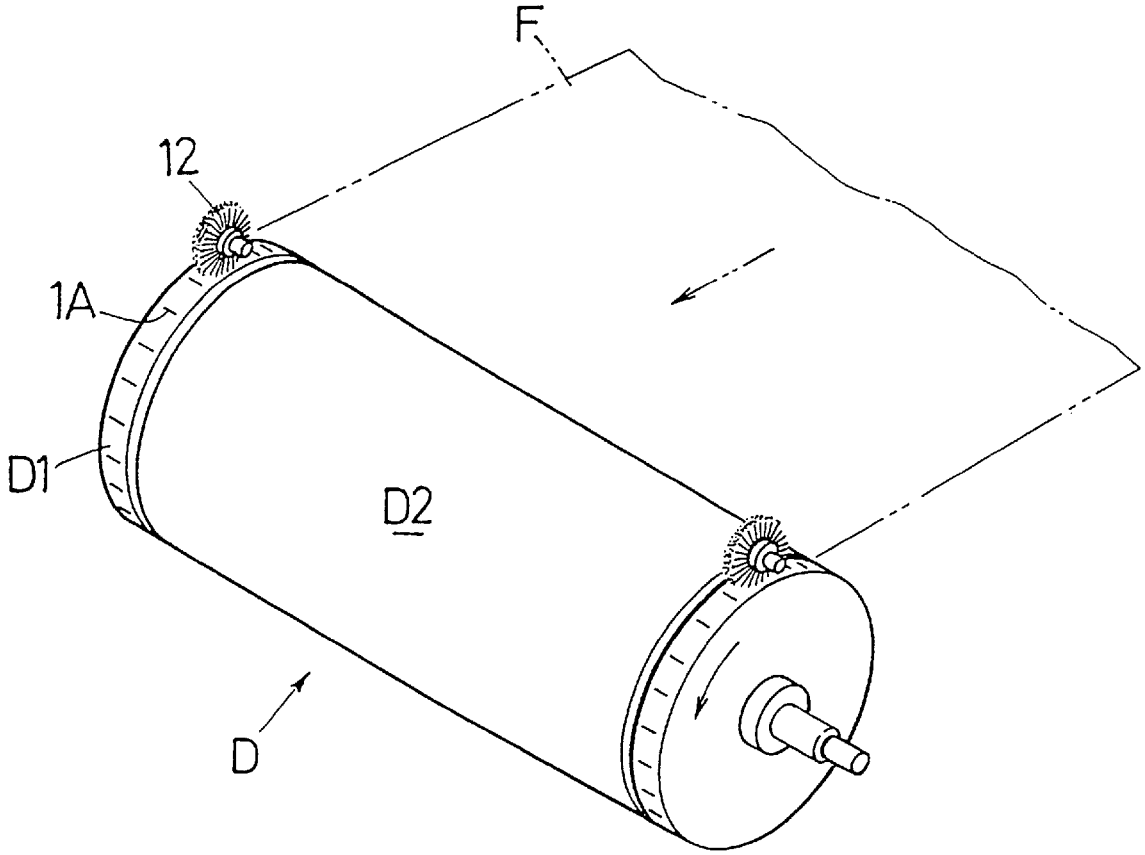
FIG. 3 is an overall view of the cloth feeding drum.

FIG. 3 shows an overall view of a cloth feeding drum. As shown in this drawing, the cloth feeding drum is an apparatus which rotates continuously so as to achieve intermittent feeding of a cloth F which is held on a drum surface thereof. In order to accomplish such operation, the cloth feeding drum comprises a drum D2 having opposite end portions and drum wheels D1, D1 provided on the opposite end portions of the drum D2, respectively. A driving apparatus for driving the cloth feeding drum is accommodated within the drum assembly of the drum D2 and drum wheels D1, D1.

In the cloth feeding drum, there are provided a plurality of support pins 1. These support pins 1 are arranged in the drum wheels D1, D1, respectively, along the roughly circumferential direction thereof with predetermined intervals. Further, in the respective drum wheel D1, these support pins 1 are adapted to be freely movable in the radial direction (hereinbelow, referred to as the up and down direction) through holes 1A formed on the drum wheel D1. Namely, each of the support pins can be moved above and below the surface of the drum wheel D1 through the respective corresponding hole 1A. Furthermore, these support pins 1 are also adapted to be movable in the axial direction of the cloth feeding drum within the holes 1A, respectively (hereinbelow, referred to as the sideways direction).

For this purpose, the holes 1A through which the support pins 1 be moved in the up and down directions are formed into a slit-like shape extending in the axial direction of the cloth feeding drum, respectively, which allow the support pins 1 to be movable in the sideways direction of the cloth feeding drum in addition to the up and down directions.

As is further shown in FIG. 3, rotating brushes 12 are provided to push the opposite sides of the cloth F against the support pins 1 of the respective drum wheels D1, D1.

Figure 4:
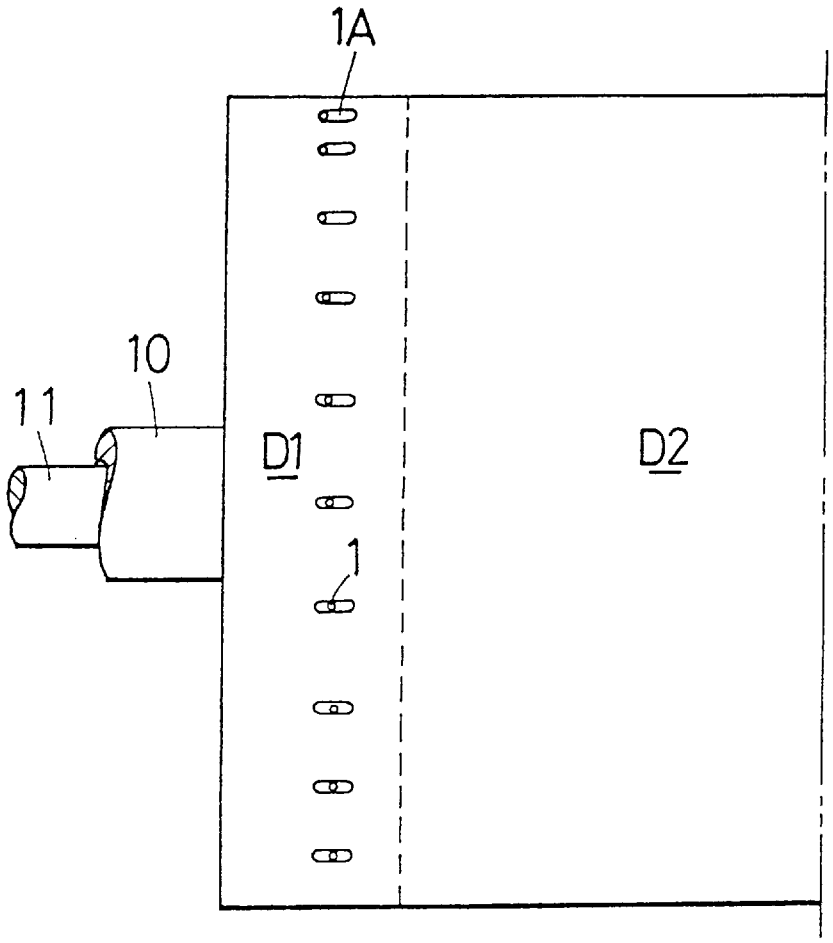
FIG. 4 is an enlarged view of a left half portion of the cloth feeding drum according to the present invention.

FIG. 4 is an enlarged view of the left half portion of the cloth feeding drum shown in FIG. 3. From this drawing, it can be understood that the support pins 1 are arranged within the slits 1A at different positions along the longitudinal direction of the respective slit 1A.

Figure 5:
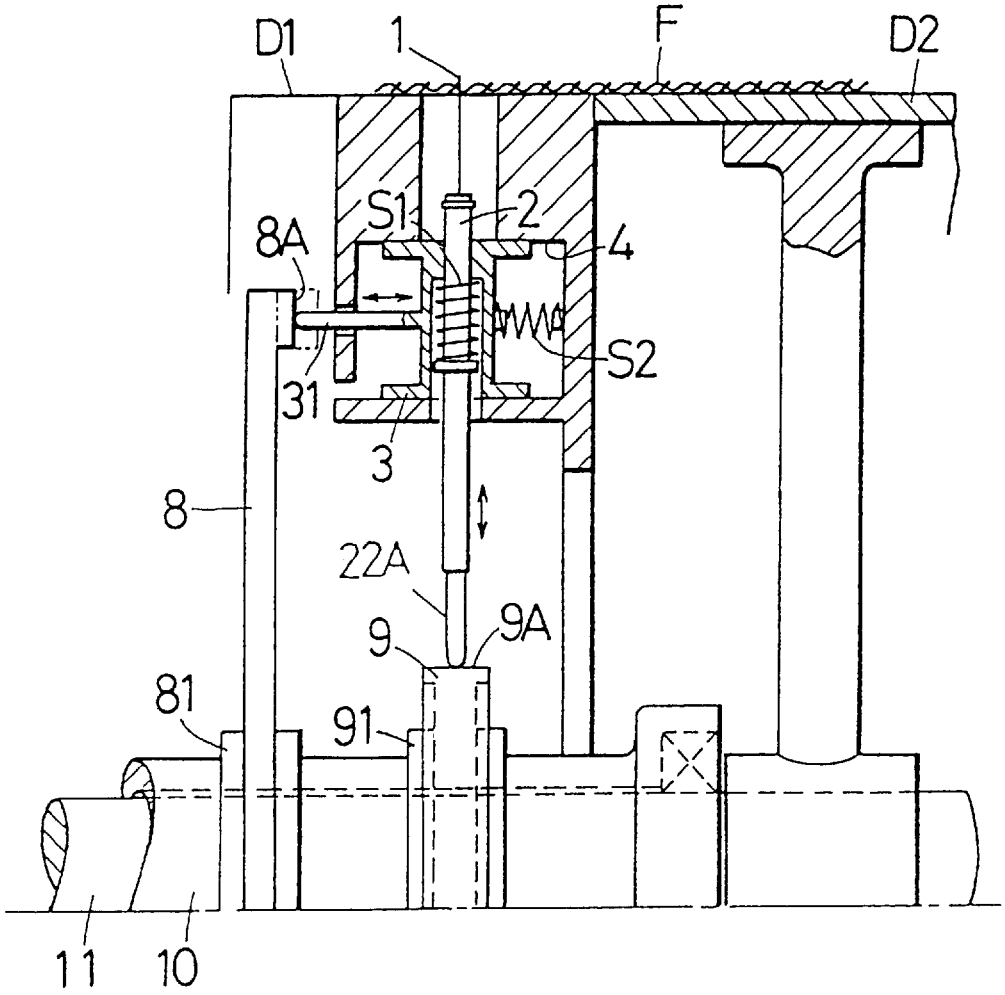
FIG. 5 is a cross sectional view which shows a first embodiment of a driving means provided in the cloth feeding drum according to the present invention.

FIG. 5 is a cross-sectional view of the first embodiment of the cloth feeding drum of the present invention, and it shows a part of a driving mechanism disposed within the respective drum wheel D1 for moving the support pins 1. The driving mechanism includes an up and down movement means (which is also referred to as a first means in claims) for moving the support pins 1 in the up and down direction and a sideways movement means for moving the support pins 1 in the sideways direction (which is also referred to as a second means or a tension applying means in claims).

Figure 6:
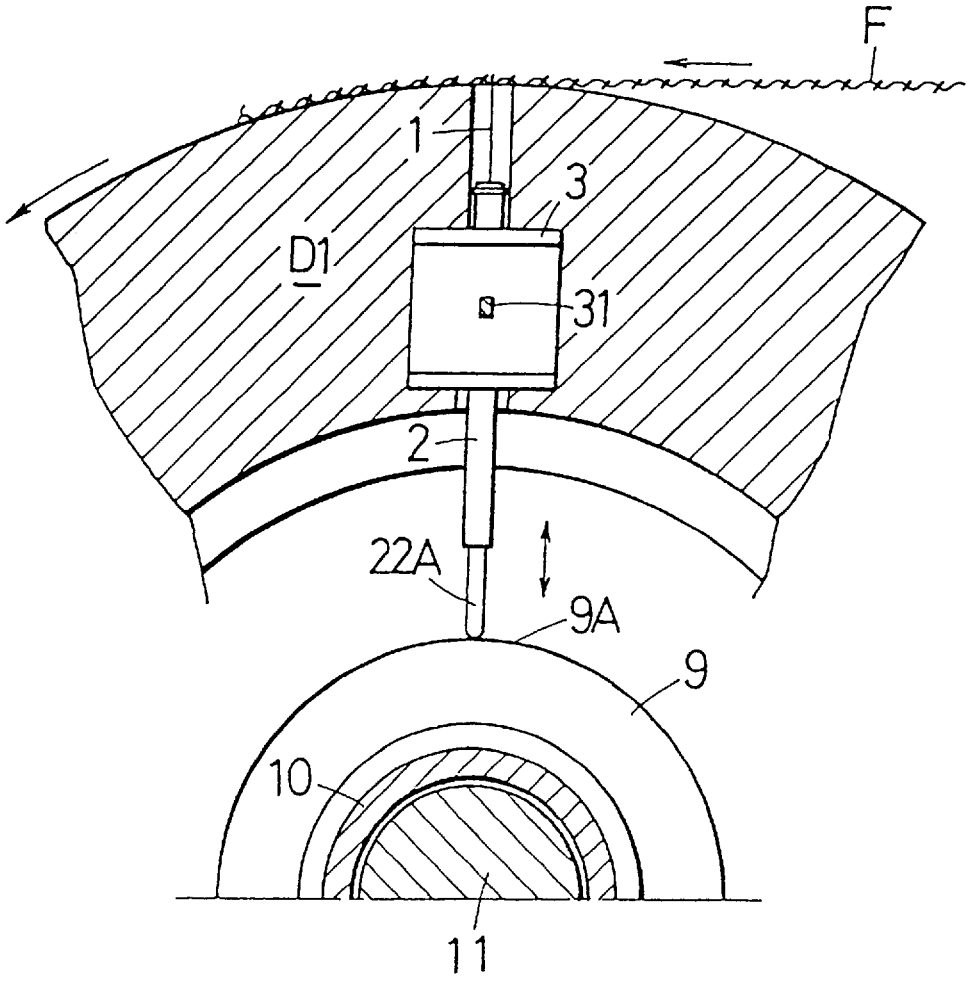
FIG. 6 is a cross sectional view of an up and down direction movement means of the driving means of the first embodiment, which is viewed from the axial direction of the cloth feeding drum.

FIG. 6 is a cross-sectional view of the up and down movement means shown in FIG. 5, which is viewed from the axial direction of the cloth feeding drum.

As stated in the above, the drum wheels D1, D1 are provided on the opposite end portions of the drum D2, respectively. In each of the drum wheels D1, D1, there is formed a space in which the driving mechanism for moving the support pins 1 is disposed.

The drum wheels D1, D1 are adapted to be rotated in accordance with rotation of a support axle 11. Namely, since these drum wheels D1, D1 are fixedly coupled to the drum D2 which is fixed to the support axle 11 through a boss 11A as shown in FIG. 5, they are rotated in accordance with the rotation of the support axle 11. In more details, a motor (not shown in the drawings) is used to rotate the support axle 11, and this causes the drum D2 which is fixedly mounted to the support axle 11 to be rotated. In accordance with the rotation of the drum D2, the drum wheels D1, D1 rotate together.

Hereinafter, the structure and operation of the sideways movement means for moving support pins 1 in the left and right direction (i.e., the sideways direction or the axial direction of the drum) will be described.

As stated in the above, the support pins 1 are used to support the cloth F on the surfaces of the drum wheels D1, D1. Each of the support pins 1 is screwed into the top of a rod-shaped support pin movement body 2 so as to extend therefrom. Therefore, the support pin 1 is freely detachable from the support pin movement body 2.

Further, the support pin movement body 2 is inserted into a hollow passage formed in a sideways movement member 3 so as to be freely slidable in the up and down direction with respect to the sideways movement member 3.

In this regard, it should be noted that the support pin movement body 2 and the sideways movement member 3 constitutes an assembly. The assembly is also used as a part of the up and down direction movement means. Accordingly, in each of the drum wheels D1, D1, a plurality of such assemblies of which number is the same as the number of the support pins 1 provided in one drum wheel D1 are arranged in the circumferential direction of the respective drum wheel D1, and each of the assemblies is operatively associated with each support pin 1. Therefore, hereinafter, a description is made with reference to one of these assemblies.

The sideways movement member 3 is disposed within a space 4 formed inside the drum wheel body of the respective drum wheel D1 in such a manner that the sideways movement member 3 is able to slidably move in the sideways direction within the space 4.

Provided between the sideways movement member 3 and an inner wall of the drum wheel D1 is a spring S2 which normally biases the sideways movement member 3 toward the left, as shown in FIG. 5.

Further, the sideways movement member 3 includes an extending portion 31 which is in slidable abutment with a cam surface 8A of a first cam 8, and as a result of this abutment, the sideways movement member 3 can be moved in the sideways direction in accordance with the shape of the cam surface 8A as shown by the arrow in FIG. 5.

Figure 7:
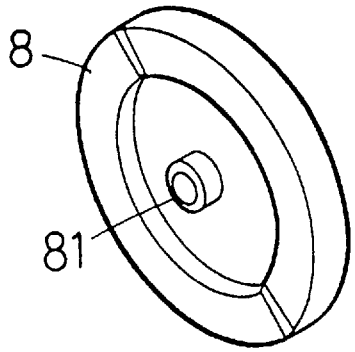
FIG. 7 is a perspective view of a first cam used in the driving means.

As shown in FIG. 7, the first cam 8 is formed into a disk-like shape having an inner peripheral portion which acts as the cam surface 8A. Further, the cam 8 is fixed to an outer axle 10 through a fixing member 81 in such a manner that they form an integral body.

The outer axle 10 is provided around the support axle 11. In this regard, it should be noted that while the support axle 11 rotates, the outer axle 10 does not rotate. Namely, the outer axle 10 remains stationary relative to the support axle 11 even if the support axle 11 rotates.

According to the structure as described above, when the drum wheels D1, D1 rotate, the sideways movement members 3 also rotate together therewith, and while this rotation is being carried out, the extending portion 31 of each of the sideways movement members 3 slidably moves on the cam surface 8A which remains stationary. Therefore, according to the rotation of the drum wheels D1, D1, some of the sideways movement members 3 are moved in the sideways direction (i.e., the axial direction) against the biasing force of the respective spring S2 in accordance with the shape of the cam surface 8A of the first cam 8.

When the sideways movement member 3 is moved in the sideways direction, the support pin movement body 2 which lies inserted within the hollow passage of the sideways movement member 3 is also moved in the sideways direction, and this in turn causes the support pin 1 mounted to the support pin movement body 2 to also move in the same way in the sideways direction within the slit 1A.

In this connection, by replacing the cam 8 with other cam having a different cam surface 8A, it is possible to change the motion of the support pin 1 in the sideways direction as desired. This means that it is possible to adjust the amount of the sideways movement of the support pin 1 appropriately by changing the cam 8.

When the first cam 8 is to be replaced, one side of the drum wheels D1, D1 (the left side in the drawings) is temporarily opened up and the fixing means 81 is detached from the outer axle 10 to release the fixed connection between the first cam 8 and the outer axle 10. Thereafter, the first cam 8 is pulled to the left along the outer axle 10 to remove the first cam 8 from the outer axle 10. Therefore, the replacement of the first cam 8 can be easily carried out.

Hereinbelow, the structure and operation of the up and down movement means for moving support pins 1 in the up and down direction will be given.

As shown in the drawings, each of the support pin movement bodies 2 which is inserted through the hollow passage of the sideways movement member 3 includes a lower extending portion having a bottom surface which is in slidable abutment with a cam surface 9A of a second cam 9.

Provided between the support pin movement body 2 and the sideways movement member 3 is a spring S1 which normally biases the support pin movement body 2 toward the cam surface 9A of the second cam 9 as illustrated in FIG. 5.

The second cam 9 is formed into a disk-like shape having a circumferential surface which acts as the cam surface 9A. The second cam 9 is fixed to the outer axle 10 which is disposed around the support axle 11 through a fixing means 91 in such a manner that the second cam 9 and the outer axle 10 form an integral body.

In this connection, it should be understood that because the outer axle 10 does not rotate and remains stationary relative to the support axle 11, the second cam 9 is also in a motionless state even if the drum wheels D1, D1 rotate.

In the same manner as was described above for the first cam 8, when the second cam 9 is to be replaced, one side of the drum wheels D1, D1 (the left side in the drawings) is temporarily opened up and the fixing means 91 is detached from the outer axle 10 to release the fixed state between the second cam 9 and the outer axle 10. Thereafter, the second cam 9 is pulled to the left along the outer axle 10 to remove the second cam 9 from the outer axle 10. Therefore, the replacement of the second cam 9 can also be easily carried out.

According to the structure described above, when the drum wheels D1, D1 rotate, the support pin movement bodies 2 also rotate together therewith. As this rotation takes place, the bottom surface of the lower extending portion of each of the support pin movement bodies 2 which is in slidable abutment with the cam surface 9A of the second cam 9 causes the support pin movement body 2 to move in the up and down direction against the biasing force of the spring S1 according to the shape of the cam surface 9A of the second cam 9.

When the support pin movement body 2 moves up and down, the support pin 1 which is mounted to the top of the support pin movement body 2 also moves up and down together with support pin movement body 2 through the slit 1A.

Figure 8:
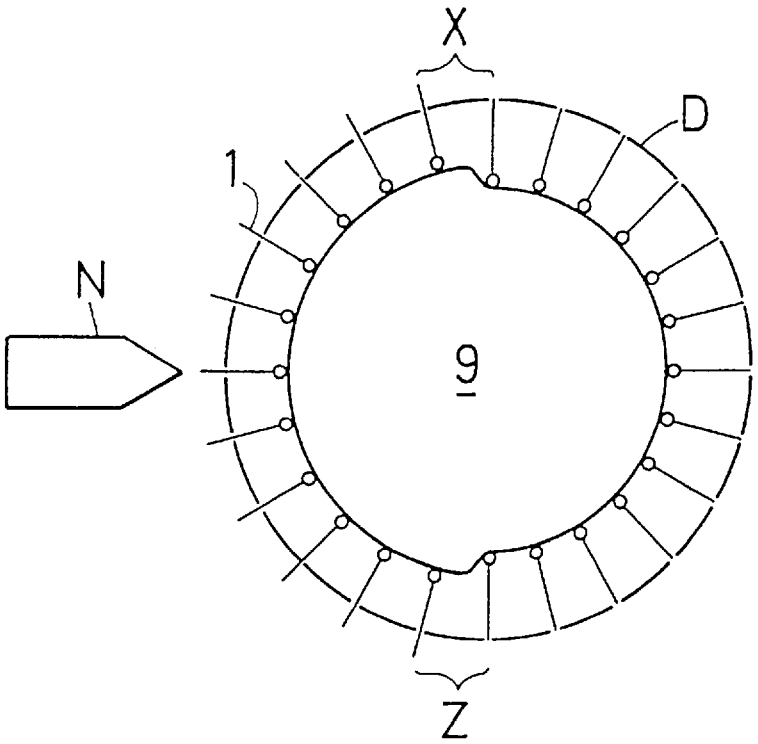
FIG. 8 is an illustration for explaining the relationship between the up and down movement of the support pins and the shape of a second cam of the driving means according to the present invention.

FIG. 8 is a cross-sectional view illustrating the relationship between the shape of the cam surface 9A of the second cam 9 and the up and down movement of the respective support pins 1. In this connection, it should be noted that the cam surface 9A has the shape as illustrated in FIG. 8.

Specifically, the second cam 9 is formed into a substantially disk-like shape having a roughly semi-circular large diameter section and a roughly semi-circular small diameter section which are Joined together to form the cam surface 9A. Therefore, two transition portions are formed on the cam surface 9A at a portion running from the large diameter section to the small diameter section and another portion running from the small diameter section to the large diameter section. The positions of these transition portions are set so as to correspond to the cloth introducing region X and the cloth separating region Z, respectively.

In the above structure, the support pins 1 mounted to the support pin movement bodies 2 which are in abutment with the cam surface 9A of the small diameter section of the second cam 9 are held below the surface of the drum wheel D1 due to the biasing force of the respective spring S1, that is they are held in the base level position.

On the other hand, the support pins 1 mounted to the support pin movement bodies 2 which are in abutment with the cam surface 9A of the large diameter section of the second cam 9 are held above the surface of the drum wheel D1 against the biasing force of the spring S1, that is they are held in the positive position.

Further, the support pins 1 mounted to the support pin movement bodies 2 which are in abutment with the transition portions of the cam surface 9A of the second cam 9 are being gradually protruded from the inside of the drum wheel or retracted into the drum wheel, respectively, according to the rotation of the drum wheels D1, D1.

Figure 9:
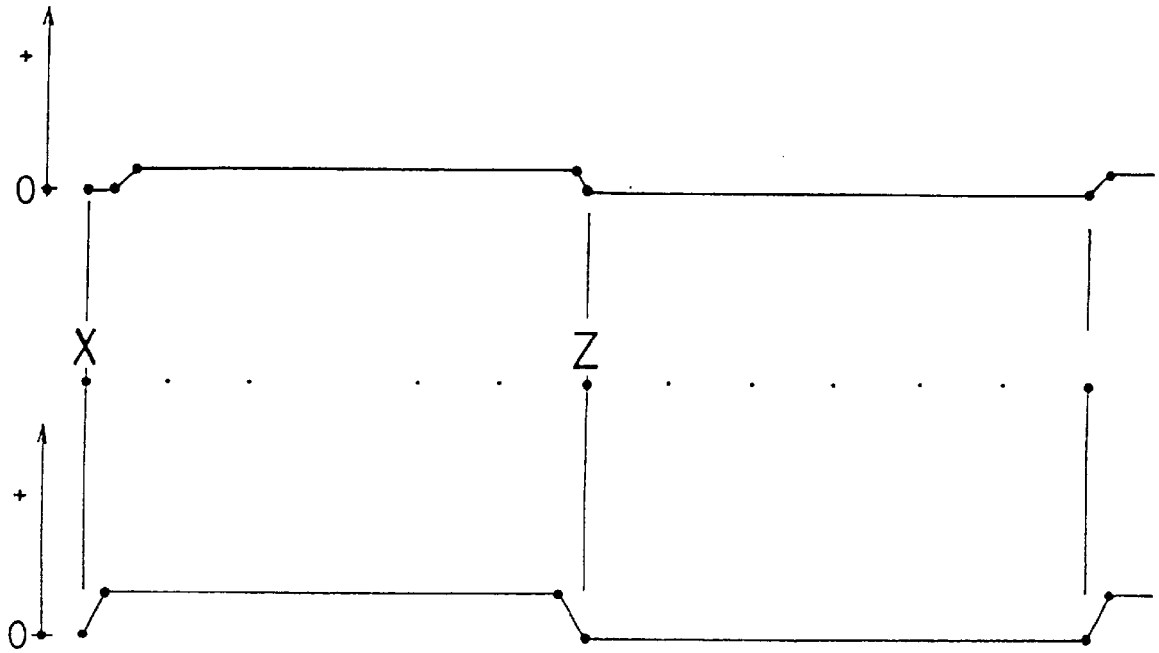
FIG. 9 is an illustration for explaining the relationship between the traces of the sideways movement of the support pins and the traces of the up and down movement of the support pins.

Now, FIG. 9 shows the relationship between the sideways motion of the support pins 1 and the up and down motion of the support pins 1.

As see from the drawing, for the movement of the support pins 1 in the sideways direction, when the cloth F reaches the introducing region X for introducing the cloth F onto the drum wheels D1, D1, the support pins 1 begin to move from their base level positions to positive positions in the axial direction of the drum wheels D1, D1 due to the biasing force of the respective spring S2.

Namely, the width between pairs of support pins 1 arranged in the drum wheels D1 and D1 on either end of the drum D2 is increased, thereby applying an increased tension to the cloth in the widthwise direction thereof to stretch out any wrinkles or the like that have been produced on the cloth in the previous step. The printing operation, namely spraying of ink onto the cloth is carried out under this condition.

After the cloth F which is held on the cloth feeding drum passes a portion of the drum where the cloth is sprayed with ink droplets from the nozzle (hereinafter, referred to as printing region Y), the cloth F is likely to swell up to produce wrinkles due to the moisture of the ink. In order to stretch such wrinkles of the cloth F, it is preferred that the support pins 1 further move to an even greater positive position than that reached at the introducing region X for further increasing a tension applied to the cloth.

Namely, the width between the pairs of support pins arranged in the drum wheels D1 on either end of the drum D2 is further increased to stretch the cloth F, thereby eliminating any wrinkles or the like that are formed in the cloth F due to the ink applied thereto.

Next, as the cloth F further moves to the separating region Z and separates from the cloth feeding drum, the support pins 1 are released from the cloth F and return to their original base level positions against the biasing force of the respective spring S2.

In this connection, it should be noted that the cam surface 8A of the first cam 8 is formed into a shape that guarantees such movement of the support pins 1 in the sideways direction.

Hereinafter, a description is made with regard to the up and down movement of the support pins 1. The support pins 1 are in the positive positions (i.e., protrude above the surface of the drum wheels D1, D1) from the introducing region X until the separating region Z, but upon passing the separating region Z, the support pins 1 return to their original base level position (i.e., beneath the surface of the drum wheels D1, D1).

Hereinbelow, a detailed description of the movement of the support pins 1 will be given.

First, in accordance with the rotation of the drum wheels D1, D1, the extending portions 31 of the sideways movement members 3 which are housed within the drum wheels D1, D1 also rotate under the condition that they are in slidable abutment with the cam surface 8A of the first cam 8 that remains stationary, whereby the sideways movement members 3 are caused to move in the sideways direction (axial direction of the drum) within the spaces 4, respectively in accordance with shape of the cam surface 8A of the first cam 8.

When the sideways movement members 3 move in the sideways direction, the support pin movement bodies 2 which are fitted through the hollow passages of the sideways movement members 3 also move in the same sideways direction, and this causes the support pins 1 to move in the same sideways direction within the slits 1A.

On the other hand, with regard to the up and down movement of the support pins 1, such operation as described hereinbelow is carried out in this situation.

Namely, since the lower extending portions 22A of the support pin movement bodies 2 are in slidable abutment with the cam surface 9A of the motionless second cam 9, the support pin movement bodies 2 are caused to move in the up and down direction according to the rotation of the drum wheels D1, D1.

Then, the support pins 1 which are mounted on the support pin movement bodies 2 are also caused to move together with the support pin movement bodies 2 in the same up and down direction through the slits 1A.

In this regard, it should be mentioned that even though the support pin movement bodies 2 move in the same sideways direction as the sideways movement members 3 in accordance with the shape of the cam surface 8A of the first cam 8, such movement only causes the lower extending portions 22A of the support pin movement bodies 2 to move either left or right (i.e., in the sideways direction) within the cam surface 9A of the second cam 9, and therefore such sideways movement does not have any effect on the up and down movement of the support pins 1.

Similarly, even though the support pin movement bodies 2 move up and down in accordance with the cam surface 9A of the second cam 9, the support pin movement bodies 2 are able to slide freely within the hollow passage formed in the sideways movement members 3, and therefore such up and down movement does not have any effect on the sideways movement of the support pins 1.

In this way, the sideways movement and the up and down movement of the support pins 1 do not interfere with each other, and therefore such movements can be carried out independently.

Moreover, by using a first cam 8 having a cam surface 8A which is formed into a uniform shape without any step or slanting portion, it is possible to completely eliminate any sideways movement of the support pins 1.

Similarly, by using a second cam 9 having a cam surface 9A which is formed into a uniform shape without any step or slanting portion, it is possible to completely eliminate any up and down movement of the support pins 1.

In this way, it is possible to select one of three possible movements for the support pins 1, that is (1) up and down movement and sideways movement; (2) up and down movement only; and (3) sideways movement only.

As was described above, the drum wheels D1, D1 are equipped with the up and down movement means and the sideways movement means which operate independently from each other to move the support pins 1. Therefore, when the drum wheels D1, D1 are rotated, such rotation can be used to cause the support pins 1 to move in the up and down direction as well as the sideways direction, or such rotation can be used to selectively move the support pins 1 in either the up and down direction or the sideways direction.

Moreover, the movement of the support pins 1 in the sideways direction (including the amount thereof) can be freely changed by changing the shape of the first cam 8, and the movement of the support pins 1 in the up and down direction (including the amount thereof) can similarly be freely changed by changing the shape of the second cam 9. These functions are referred to as the moving amount adjusting means or third means in claims.

Hereinbelow, a description of a second embodiment of the present invention will be given below.

Figure 10:
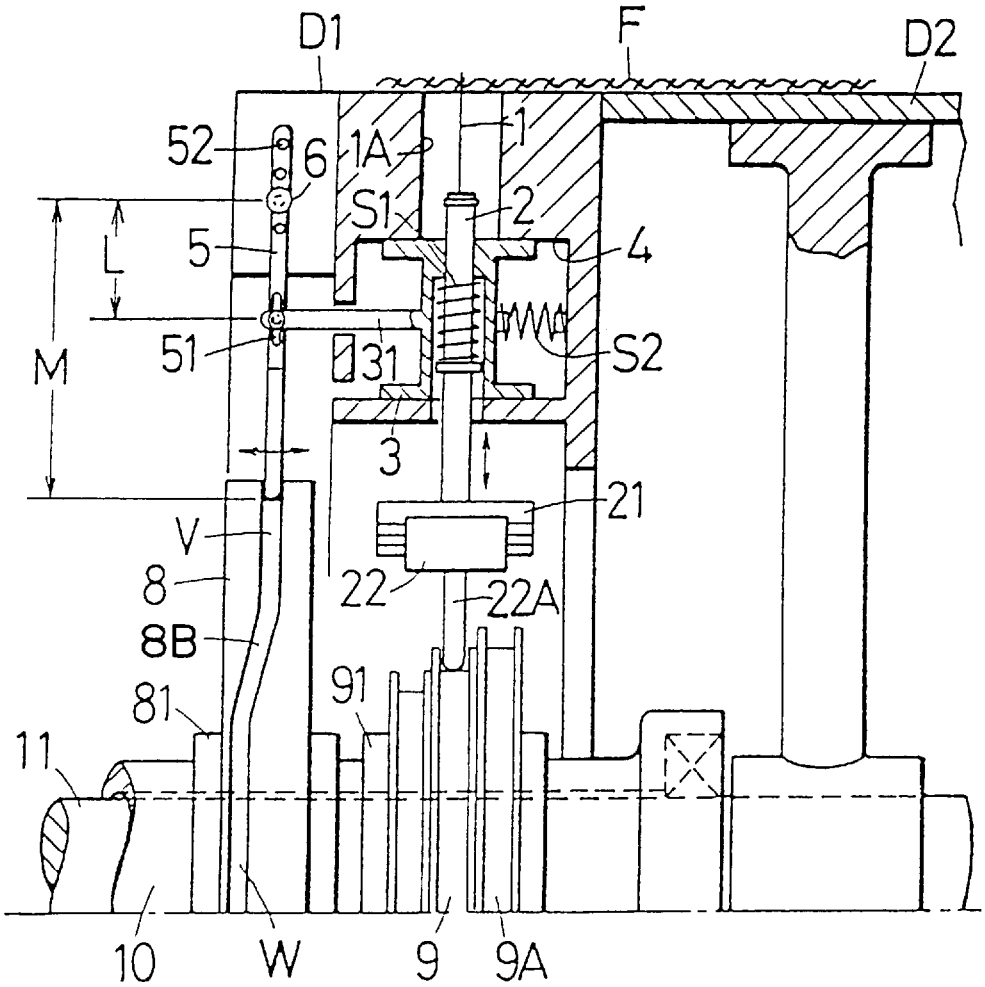
FIG. 10 is an illustration which shows a second embodiment of the driving means of the cloth feeding drum according to the present invention.

FIG. 10 shows the second embodiment of the present invention, in which a different type of driving means, namely means for moving the support pins 1, is arranged within the drum wheels D1, D1 of the cloth feeding drum for moving the support pins 1 in the radial direction (i.e., the up and down direction) and the axial direction (i.e., the sideways direction).

Figure 11:
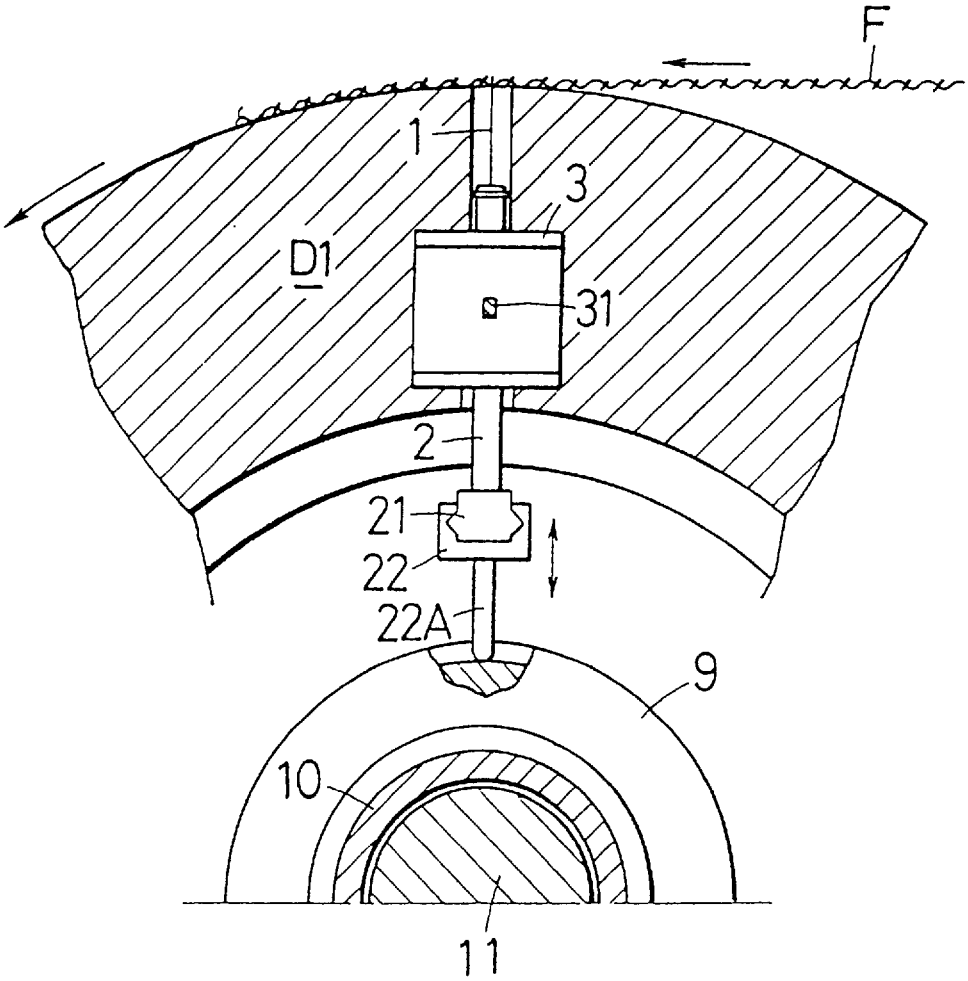
FIG. 11 is an illustration of an up and down direction movement means of the driving means of the second embodiment, which is viewed from the axial direction of the cloth feeding drum.

FIG. 11 is a cross-sectional view of the up and down movement means shown in FIG. 10, which is viewed from the axial direction of the cloth feeding drum.

First, the structure and operation of the sideways movement means for moving support pins 1 in the sideways direction will be given.

Similar to the first embodiment described above, the second embodiment also includes a plurality of sideways movement members 3 each having a hollow passage formed in the middle thereof, and a plurality of support pin movement bodies 2 which are inserted through the hollow passages of the sideways movement members 3, respectively, to allow each support pin movement body 2 to be slidable relative to the sideways movement member 3 in the up and down direction. The sideways movement member 3 and the up and down movement body 2 constitute an assembly, and a plurality of such assemblies of which number is the same as the number of the support pins 1 provided on the respective drum wheel D1 are arranged in the circumferential direction of the respective drum wheels D1, D1 so as to be associated with the support pins 1. Further, in the same manner as the first embodiment, each of the sideways movement members 3 is fitted into a space 4 formed inside the drum wheel body of the respective drum wheels D1, D1 in such a manner that the sideways movement members 3 are able to move in the sideways direction within the respective space 4. Therefore, the same or corresponding components and elements are indicated by the same reference numerals between the first and second embodiments.

Now, the main difference between the first embodiment described above and the second embodiment is that the second embodiment is further equipped with sideways movement width adjusting means (referred as third means or moving amount adjusting means in claims) to enable the amount of movement of the sideways movement members 3 in the sideways direction to be adjusted. Since such sideways movement width adjusting means is provided in each of the sideways movement member 3, the description is made with reference to one of the sideways movement width adjusting means.

Figure 12:
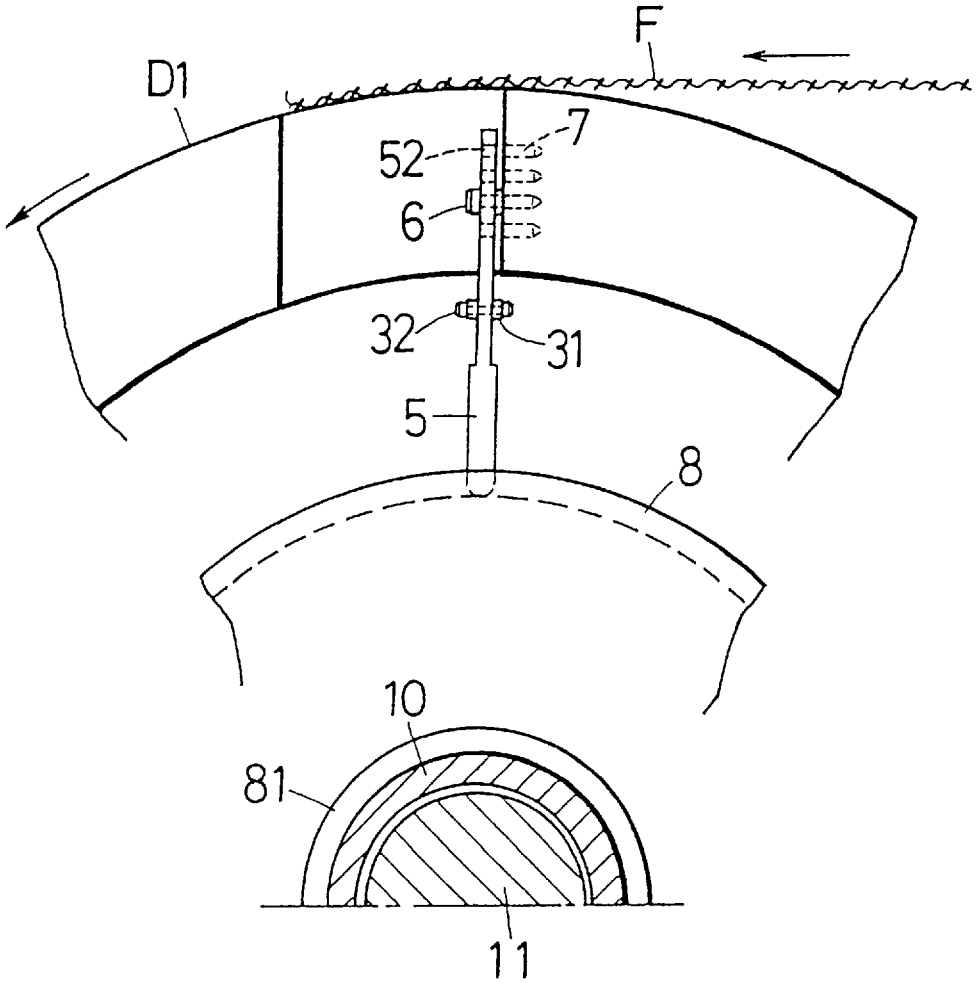
FIG. 12 is an illustration which shows a sideways movement adjusting means of the second embodiment, which is viewed from the axial direction of the cloth feeding drum.

In this connection, FIG. 12 is a cross-sectional view of the sideways movement width adjusting means, which is viewed from the axial direction of the cloth feeding drum.

As shown in FIG. 10, the sideways movement width adjusting means is constructed from an adjustment rod 5 having a plurality of holes 52, a pivotal axis 6 which is inserted through any one of the holes 52 of the adjustment rod 5, and adjustment holes 7 formed in the body of the drum wheel D1 to receive the pivotal axis 6.

Further, a fitting groove 51 is formed at a prescribed position in the adjustment rod 5. The end of the extending portion 31 of the sideways movement member 3 is fitted via a pin into the fitting groove 51.

Further, as described in the above, the plurality of holes 52 which are spaced at prescribed distances from each other are formed in the adjustment rod 5. The pivotal axis 6 is inserted into any one of these holes 52 to adjust the amount of the displacement of the adjustment rod 5 about the pivotal axis 6.

Specifically, in this connection, the adjustment holes 7 are formed in the body of the drum wheel D1 at prescribed intervals corresponding to those of the holes 52 of the adjustment rod 5.

Accordingly, by inserting the pivotal axis 6 through any one of the holes 52 in the adjustment rod 5 and fitting the pivotal axis 6 into the corresponding adjustment hole 7, the pivotal axis 6 becomes fixed to serve as a pivot point for the adjustment rod 5.

With the pivotal axis 6 as a pivot point, the lower end of the adjustment rod 5 is able to pivot. In this construction, because the pivotal axis 6 can be fixed in any one of the adjustment holes 7 through the corresponding hole 52 in the adjustment rod 5, the distance L between the pivotal axis 6 and the fitting portion of the adjustment rod 5 where the extending portion 31 of the sideways movement member 3 is fitted into the fitting groove 51 can be freely adjusted.

Further, in this embodiment, the lower end of the adjustment rod 5 is fitted into a cam groove 8B formed on a circumferential surface of a first cam 8 to enable such lower end to move in the sideways direction by following the path of the cam groove 8B.

As is made clear by FIG. 10, when the lower end of the adjustment rod 5 is in engagement with a section V of the cam groove 8B of the first cam 8, it provides the situation in which the cloth holding width provided between a pair of support pins 1 is made narrow, and when the lower end of the adjustment rod 5 is in engagement with a section W of the cam groove 8B of the first cam 8, it provides the situation in which the cloth holding width between the pair of support pins 1 is made wide.

In this construction, when the adjustment rod 5 is moved in the sideways direction, the sideways movement member 3 which is coupled thereto through the extending portion 31 also moves sideways, and as a result, the support pin movement body 2 which lies inserted through the hollow passage of the sideways movement member 3 also moves sideways.

Next, an explanation is made with reference to the case where the pivotal axis 6 is displaced from the above hole 52 and the corresponding adjustment hole 7 shown in FIG. 10 to a different hole 52 and a corresponding adjustment hole 7 which are positioned far away from the first cam 8.

In this case, the distance L from the pivotal axis 6 to the coupling portion between the adjustment rod 5 and the extending portion 31 of the sideways movement member 3 is increased, and this also results in an increase in the distance M from the pivotal axis 6 to the lower end of the adjustment rod 5 which lies within the cam groove 8B (i.e., the rotation radius of the adjustment rod 5).

As a result, since the degree of the sideways movement of the sideways movement member 3 is decreased, the degree of the sideways movement of the support pin 1 is also decreased.

On the other hand, when the pivotal axis 6 is fixed to a hole 52 and an adjustment hole 7 which are positioned closer to the first cam 8, the distance L and the distance M are decreased.

As a result, since the degree of the sideways movement of the sideways movement member 3 is increased, the degree of the sideways movement of the support pin 1 is also increased in the same way.

As described in the above, according to the second embodiment, by changing the fitting position of the pivotal axis 6 with respect to a hole 52 of the adjustment rod 5, it is possible to change the rotation radius of the adjustment rod 5, and as a result, it becomes possible to change the sideways movement width of the sideways movement member 3, namely it becomes possible to freely change the sideways movement width of the support pin 1.

Next, a description will be given with reference to the up and down movement means of the second embodiment for moving support pins 1 in the up and down direction.

In this regard, the up and down movement means of the second embodiment differs from that of the first embodiment. Namely, the lower portion of the support pin movement body 2 is provided with a rail body 21 that forms an integral part therewith, and fitted into this rail body 21 so as to be slidable with respect thereto is an adjustment sliding body 22.

Now, in the first embodiment, because only a single cam body is provided as the second cam 9, it is necessary to replace the second cam 9 with another cam in order to change or adjust the up and down movement distance.

However, in this second embodiment, there are provided a plurality of second cams 9 each having a cam surface 9A of a different shape. Therefore, when the up and down movement distance of the support pins 1 is to be changed, the adjustment sliding body 22 is moved along the rail body 21 so that the extending portion 22A of the sliding body 22 is put onto cam surface of a different cam. This function is also referred to as the moving amount adjusting means in claims. For example, the extending portion 22A can be moved from the top of the cam 9 to the top of the adjacent cam 9.

In this connection, the support pin movement body 2 is normally biased by the spring body S1 toward the cam surface 9A of the second cam 9. Therefore, when the second cam 9 is to be replaced with other cam, the support pin movement body 2 is moved slightly upward against the biasing force of the spring S1 and then moved sideways by means of the slidable engagement between the sliding body 22 and the rail body 21 to put the extending portion 22A of the support pin movement body 2 on the top of the cam surface of the other cam 9.

In this regard, it should be understood that if it is desired to replace one or more of the cam bodies of the second embodiment with other cam bodies, the replacement can be performed in the same manner as was described above for the first embodiment.

Finally, a comparison will be made between the present invention and the cloth feeding drums of the prior art.

Figure 13:
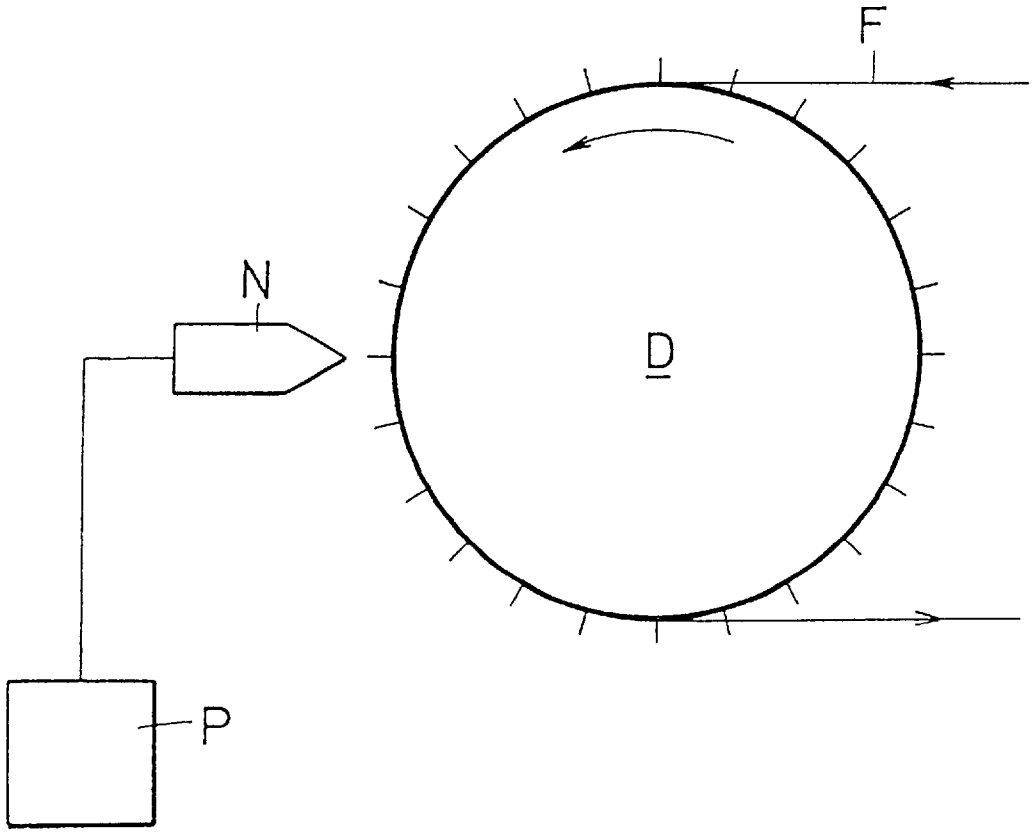
Fig. 13 Prior Art
FIG. 13 is an illustration which shows support pins mounted on a cloth feeding drum of prior art apparatuses.
Figure 14:
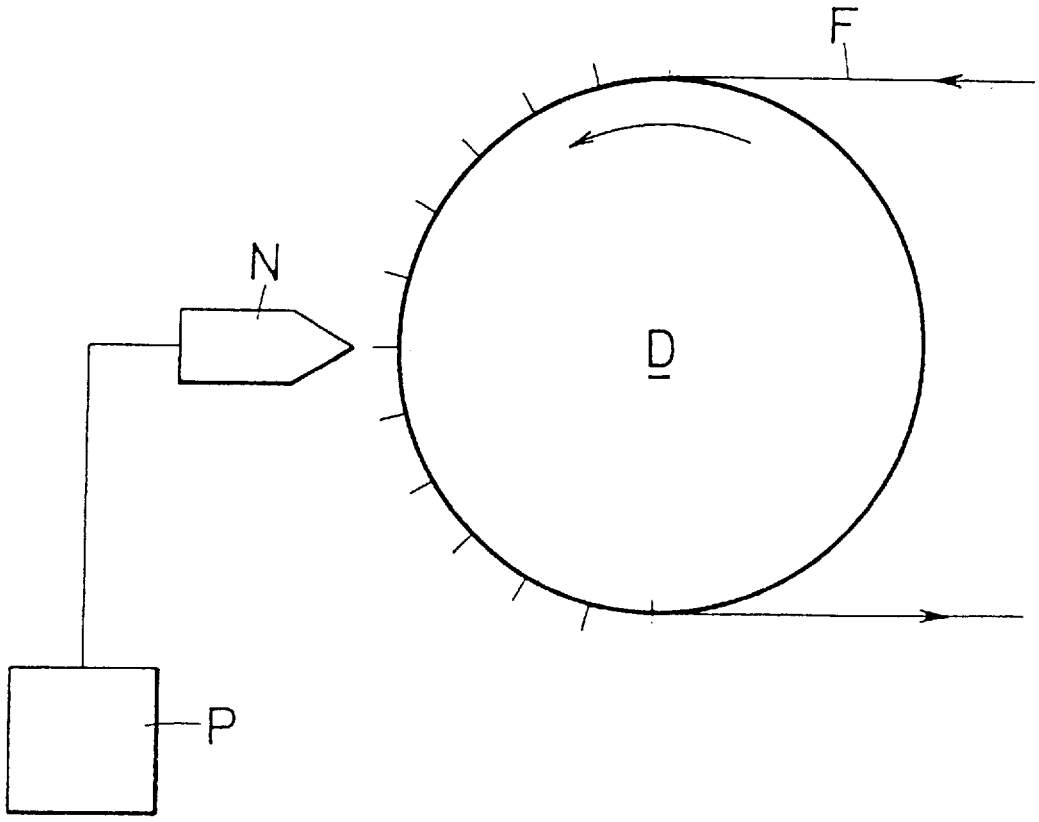
FIG. 14 is an illustration which shows support pins provided in the cloth feeding drum according to the present invention.

In this connection, FIGS. 13 and 14 are illustrations used to compare the relationship between the support pins 1 and a cloth F of a prior art cloth feeding drum with that of the cloth feeding drum according to the present invention.

In the case of the prior art cloth feeding drum (FIG. 13), the support pins 1 always protrude above the surface of the cloth feeding drum.

However, in the case of the present invention (FIG. 14), the support pins 1 protrude above the surface of the cloth feeding drum over the region where the cloth F is held on the cloth feeding drum, but over the region where the cloth F is not held, the support pins 1 are retracted below the surface of the cloth feeding drum.

Namely, the support pins 1 are forced to protrude out above the surface of the cloth feeding drum to pierce the cloth F at the introducing region X for introducing the cloth F onto the cloth feeding drum, and then the support pins 1 are removed from the cloth F and retracted below the surface of the cloth feeding drum at the separating region Z. Therefore, these operations of protruding the support pins 1 to pierce the cloth F and then retracting the support pins 1 to remove the support pins 1 from the cloth F are carried out smoothly.

It is to be noted that the present invention is in no way limited to the embodiments described above, and many changes, alterations and/or additions may be made thereto without departing from the scope and spirit of the present invention as defined by the appended claims.

For example, even though the up and down movement means for moving the support pins in the up and down direction and the sideways movement means for moving the support pins in the sideways direction of the embodiments described above utilize the cam mechanism as described above, it is also possible to employ electrical driving apparatuses to perform the same or similar functions.

Furthermore, even though the cloth holding region of the cloth feeding drum is provided so as to extend about 180 degrees in the embodiments described above, it is possible to use a cloth holding region having any degree desired.

As was described above, according to the present invention, the operations of protruding the support pins and retracting the support pins can be carried out smoothly, and thus the present invention makes it possible to provide a cloth feeding drum and an ink Jet printing apparatus having such a cloth feeding drum that can maintain stable holding conditions for a cloth on the cloth feeding drum. Further, ink Jet printing can be carried out onto a cloth under the condition that wrinkles formed thereon are stretched by the applied tension. Furthermore, wrinkles formed during the ink Jet printing operation can also be stretched.

Consequently, it is possible to prevent wrinkles and the like from being formed on the cloth. Further, it is also possible to prevent the rotational speed of the cloth feeding drum from being changed, and this makes it possible to effectively obtain accurately printed patterns on a cloth.

What is claimed is:

1. A method of carrying out ink jet printing a cloth, comprising the steps of:

introducing a cloth to be ink jet printed onto a cloth feeding drum, said cloth feeding drum having a plurality of support pins for holding said cloth on said cloth feeding drum;

moving said support pins in the radial direction of said cloth feeding drum at least when said cloth is introduced onto said cloth feeding drum; and moving said support pins on said cloth feeding drum in the axial direction thereof at least when the ink jet printing is performed on said cloth on said cloth feeding drum, said support pins applying a tension to the cloth held on said cloth feeding drum.

2. The method of carrying out ink jet printing as claimed in claim 1, wherein said support pins are moved to protrude above a surface of said cloth feeding drum to pierce said cloth.

3. The method of carrying out ink jet printing as claimed in claim 2, wherein said support pins are moved so as to retract below the surface of said cloth feeding drum when the cloth is removed from said cloth feeding drum.

4. An ink jet printing apparatus, comprising:

a rotatable cloth feeding drum having opposite end portions in the axial direction thereof, said cloth feeding drum having a plurality of support pins for holding a cloth to be ink jet printed on said cloth feeding drum, said plurality of support pins being arranged circumferentially in each of the opposite end portions;

a nozzle for spraying ink onto the cloth held on said cloth feeding drum by said support pins to carry out the ink jet printing, said nozzle being movable relative to said cloth feeding drum along the axial direction thereof; and means provided in said cloth feeding drum for applying an appropriate tension to the cloth in the widthwise direction of the cloth while the ink jet printing is being carried out, and said means including means for moving at least one of the support pins in at least one of said opposite end portions in the axial direction of said cloth feeding drum after the cloth is introduced onto said cloth feeding drum.

5. The ink jet printing apparatus as claimed in claim 4, said tension applying means includes a first cam provided in said cloth feeding drum for moving said support pins on said cloth feeding drum in the axial direction thereof.

6. The ink jet printing apparatus as claimed in claim 4, further comprising means for adjusting the moving amount of said support pins.

7. The ink jet printing apparatus as claimed in claim 4, further comprising means for moving said support pins in the radial direction of said cloth feeding drum.

8. The ink jet printing apparatus as claimed in claim 7, wherein said means for moving said support pins in the radial direction is adapted to protrude said support pins from of said drum to pierce the cloth at least when the cloth is introduced onto said cloth feeding drum.

9. The ink jet printing apparatus as claimed in claim 8, wherein said means for moving said support pins in the radial direction is adapted to retract said pins into said cloth feeding drum to remove said pins from the cloth when the cloth is removed from said cloth feeding drum.

10. The ink jet printing apparatus as claimed in claim 7, wherein said means for moving said support pins in the radial direction includes a second cam provided within said cloth feeding drum for moving the support pins in the radial direction of said cloth feeding drum.

11. The ink jet printing apparatus as claimed in claim 7, further comprising means for adjusting the moving amount of said support pins in the radial direction of said cloth feeding drum.

12. A method of carrying out ink jet printing, comprising the steps of:

holding a cloth to be ink jet printed on a cloth feeding drum, said cloth feeding drum having a plurality of support pins; and carrying out the ink jet printing on said cloth on the cloth feeding drum while said support pins are being moved on the cloth feeding drum in the axial direction thereof so as to apply a tension to the cloth.

13. A cloth feeding drum apparatus for ink jet printing, comprising:

a drum having a plurality of support pins for holding a cloth to be ink jet printed on said drum;

first means provided in said drum for moving said support pins in the radial direction of said drum; and second means provided in said drum for moving said support pins on the drum means in the axial direction of said drum, said second means being configured to apply a tension to the cloth at least when the ink jet printing is performed on the cloth on said drum.

14. The cloth feeding drum as claimed in claim 13, wherein said first means is actuated at least when the cloth is introduced onto said drum.

15. The cloth feeding drum as claimed in claim 13, wherein said second means is actuated after the cloth has been introduced onto said drum.

16. The cloth feeding drum as claimed in claim 13, further comprising means for adjusting the moving amount of said support pins.

17. A cloth feeding drum apparatus for ink jet printing, comprising:

a drum having a plurality of support pins for holding a cloth to be ink jet printed; and means provided in said drum for moving said support pins on said drum in the axial direction thereof so as to apply a tension to the cloth at least when the ink jet printing is performed on the cloth on said drum.

18. The cloth feeding drum as claimed in claim 17, wherein said support pins moving means is actuated after the cloth is introduced onto said drum means.

19. The cloth feeding drum as claimed in claim 17, further comprising means for adjusting the moving amount of said support pins.

* * * * *